US008217377B2

(12) United States Patent
Jepsen et al.

(10) Patent No.: US 8,217,377 B2
(45) Date of Patent: Jul. 10, 2012

(54) DEVICE WITH MOVABLE SENSOR FOR MEASURING THE WIDTH AND/OR THE POSITION OF A METAL STRIP OR SLAB

(75) Inventors: Olaf Norman Jepsen, Siegen (DE); Rolf Franz, Kreuztal (DE); Matthias Tuschhoff, Siegen (DE); Matthias Kipping, Herdorf (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 516 days.

(21) Appl. No.: 12/227,532

(22) PCT Filed: Apr. 7, 2007

(86) PCT No.: PCT/EP2007/003152

§ 371 (c)(1),
(2), (4) Date: Nov. 20, 2008

(87) PCT Pub. No.: WO2007/137649

PCT Pub. Date: Dec. 6, 2007

(65) Prior Publication Data

US 2009/0116041 A1 May 7, 2009

(30) Foreign Application Priority Data

May 27, 2006 (DE) ..... 10 2006 024 761

(51) Int. Cl.
*G01N 21/86* (2006.01)
*G01V 8/00* (2006.01)

(52) U.S. Cl. ..... 250/559.24; 250/559.27; 356/630; 356/635; 33/711

(58) Field of Classification Search ..... 250/559.27, 250/559.24, 559.36, 559.4; 33/783, 501.02, 33/711, 784; 356/485, 630, 635, 636, 908
See application file for complete search history.

(56) References Cited

U.S. PATENT DOCUMENTS

| | | | | |
|---|---|---|---|---|
| 2,552,459 | A | 5/1951 | Rice | |
| 2,779,549 | A | 1/1957 | Teplitz | |
| 4,271,477 | A * | 6/1981 | Williams | 702/172 |
| 4,974,333 | A * | 12/1990 | Ginzburg | 33/783 |
| 5,344,597 | A * | 9/1994 | Robertson | 264/40.6 |

FOREIGN PATENT DOCUMENTS

| | | |
|---|---|---|
| EP | 1 125 658 | 8/2001 |
| GB | 795 525 | 5/1958 |
| GB | 2 138 180 | 10/1984 |
| GB | 2 138 180 A | 10/1984 |
| JP | S45-8780 | 3/1970 |
| JP | 61108415 | 5/1986 |
| JP | 63010017 | 1/1988 |
| JP | 63194803 | 8/1988 |
| JP | 63194804 | 8/1988 |

* cited by examiner

*Primary Examiner* — Francis M Legasse, Jr.
(74) *Attorney, Agent, or Firm* — Lucas & Mercanti, LLP; Klaus P. Stoffel

(57) ABSTRACT

The invention relates to a device (1) for measuring the width (B) and/or the position of a metal strip (2) or a slab, which has at least two measuring systems (3, 4), with each located on a side (5, 6) of the metal strip (2) or the slab, wherein each measuring system (3, 4) has a sensor (7) designed to detect the lateral end (8, 9) of the metal strip (2). To make the measuring device robust and to enable dynamic measurement, according to the invention the sensor (7) is located on a moving element (10) with which it can be moved in a straight line in a direction (Q) at right angles to the longitudinal direction (L) of the metal strip (2).

12 Claims, 7 Drawing Sheets

DEVICE WITH MOVABLE SENSOR FOR MEASURING THE WIDTH AND/OR THE POSITION OF A METAL STRIP OR SLAB

BACKGROUND OF THE INVENTION

The invention concerns a device for measuring the width and/or position of a metal strip or slab, which has at least two measuring systems, one on each side of the metal strip or slab, where each measuring system has a sensor designed to detect the lateral edge of the metal strip or slab.

The width of strips is often measured by contactless methods, e.g., optically by photoelectric cells or cameras arranged vertically above the strip and especially near the edge of the strip. Another possible means of determining the lateral edge of a metal strip or a slab is by radiometry. Mechanical measurement by means of a measuring roller is also well known. In this method, the deflection of the measuring roller transverse to the longitudinal direction of the metal strip or slab is determined. Strips are measured both in cold rolling mills and hot rolling mills.

Measurement of the width of the strip or slab before the edging process in a conventional hot strip mill is especially important. The width of the strip or slab is the input variable for the automatic width control. A functional automatic width control system in turn is a critical entity for the geometric quality of the hot strip and thus also has a corresponding influence on the economy of a hot strip mill.

A device of this general type is disclosed, for example, in GB 2 138 180 A. A metal strip to be rolled passes through a rolling stand, and sensors for determining the position of the lateral edges of the strip are arranged on both sides of the lateral edges of the metal strip. In one embodiment, these sensors are mounted in a stationary position, and an optical system is used to detect the lateral edge of the metal strip. In another embodiment, a roller rests against the lateral edge of the strip and is mounted in such a way that it can move in the direction transverse to the longitudinal axis of the metal strip against the force of a spring. The deflection of the roller is measured, and this makes it possible to infer the position of the location of the lateral edge of the metal strip. Two measuring systems of this type can cooperate with each other to determine the width of the strip.

Another solution is known from DE 31 16 278 A1. In this case, a roller that is set against the edge of the strip is provided on both sides of the metal strip. The roller is mounted on an elastic arm, which allows a deflection of the roller in the direction transverse to the longitudinal axis of the metal strip. Strain gauges are mounted on the elastic arm in such a way that when the arm is deflected, it is possible to infer the deflection of the roller and thus, when two such measuring systems are used, to infer the strip width.

EP 0 166 981 B1 describes a positioning control device for guide plates or guide rollers, which are mounted in such a way that they can be displaced transversely to the rolling direction of a metal strip or slab. The displacement of the guide plate or guide roller is carried out automatically.

Another solution for adjusting lateral guide elements for a metal strip in a rolling installation is described in EP 0 925 854 A2. In this case, sensors that can measure the distance of the guide element from the edge of the strip are integrated in the guide elements. JP 61[1986]-108,415 A discloses a similar solution.

According to EP 1 125 658 A1, stationary gap sensors are used to determine the position of the edge of a continuously cast metal strip or slab.

Sensors for measuring the thickness of the rolled strip or the slab in a rolling installation are disclosed by JP 63[1988]-194,804 A, which describes measuring rollers that lie on the upper side and the underside of the rolled product. The use of measuring rollers of this type is also known from JP 63[1988]-194,803 A.

JP 63[1988]-010,017 A describes a system in which measuring rollers adjacent to the edges of the strip are equipped with a sensor, which, as the roller approaches the edge of the strip, reduces the approach speed in time to prevent the measuring roller from damaging the edge of the strip. The manner in which measuring roller is moved up to the strip edge is not described in detail.

The ambient conditions during the width measurement of a near-net strip in the vicinity of an edger or a slab upsetting press are characterized by high temperatures, heavy scale production, cooling water, steam, strong vibrations, etc. These ambient conditions can cause breakdowns or measuring errors with the conventional measuring principles that are employed, because, for example, scale, water, etc., can be deposited on cameras and photoelectric cells. Strong vibrations arising from the production process can affect or damage the electronics of the installation.

This leads to a preference for mechanical measuring systems, especially measuring rollers. It is necessary—of course, not just in this case, but especially in this case—that the width of the metal strip or slab can be determined in a very dynamic way, i.e., the ability of the sensors to move in the direction transverse to the longitudinal direction of the metal strip or slab must be marked by high speed if an optimum measurement result is to be obtained.

Naturally, however, due to the harsh ambient conditions, a robust mode of operation of the device must be guaranteed.

All previous solutions have had to accept limitations in this respect.

Therefore, the objective of the invention is to further develop a device of the aforementioned type in such a way that the disadvantages cited above are avoided or at least reduced. The device for measuring the width and/or the position of the metal strip should operate very robustly and highly dynamically and should be insensitive to ambient conditions.

SUMMARY OF THE INVENTION

In accordance with the invention, this objective is achieved by mounting the sensor on a moving element that allows it to make translational movements in a direction transverse to the longitudinal direction of the metal strip.

In this connection, the moving element can be a linear slide. In an alternative embodiment, the moving element is part of a rolling installation, especially a lateral guide plate for the metal strip or slab.

The sensor can be mounted on a supporting arm, which can swivel on the moving element, with the axis of rotation pointing in the direction normal to the metal strip or slab.

This allows especially dynamic positioning of the sensor, which is not found in previously known solutions.

The sensor can be of a mechanical design. In this case, it is preferably a dancer roller designed to rest against the lateral edge of the metal strip or slab. In this regard, the dancer roller can be designed as at least one disk that has a diameter significantly greater than its width. Several disks can be arranged in succession in the axial direction.

Furthermore, in addition to the one or more disks, at least one conically designed disk can be mounted after them in the axial direction. The dancer roller can have a coating of a heat-resistant and/or wear-resistant material.

The sensor can also be a contactless measuring device. In this case, it is preferably provided that the contactless measuring device is an optical measuring device, especially a scanner.

At least one linear actuator can be provided for moving the moving element and possibly the supporting arm. In addition, measuring means can be provided, with which the translational displacement movement of the moving element and possibly the swivel angle of the supporting arm can be measured.

The device described above is preferably part of a slab casting installation, a hot strip mill, a cold rolling mill, a wire mill, a section mill, a plate mill, a dressing and straightening line, a billet mill, or a slitting line.

The proposed device allows measurement of the width or position of a metal strip or slab that is adapted to ambient conditions and is robust and sufficiently accurate. The measuring device can be located in the roughing train of a hot strip mill, but it can also be used in all other sections in which it is necessary to measure the width of a metal strip—independently of the strip thickness, the direction of strip travel (in the case of a reversing operation), and the temperature.

BRIEF DESCRIPTION OF THE DRAWING:

The drawings illustrate specific embodiments of the invention.

Figure 1:
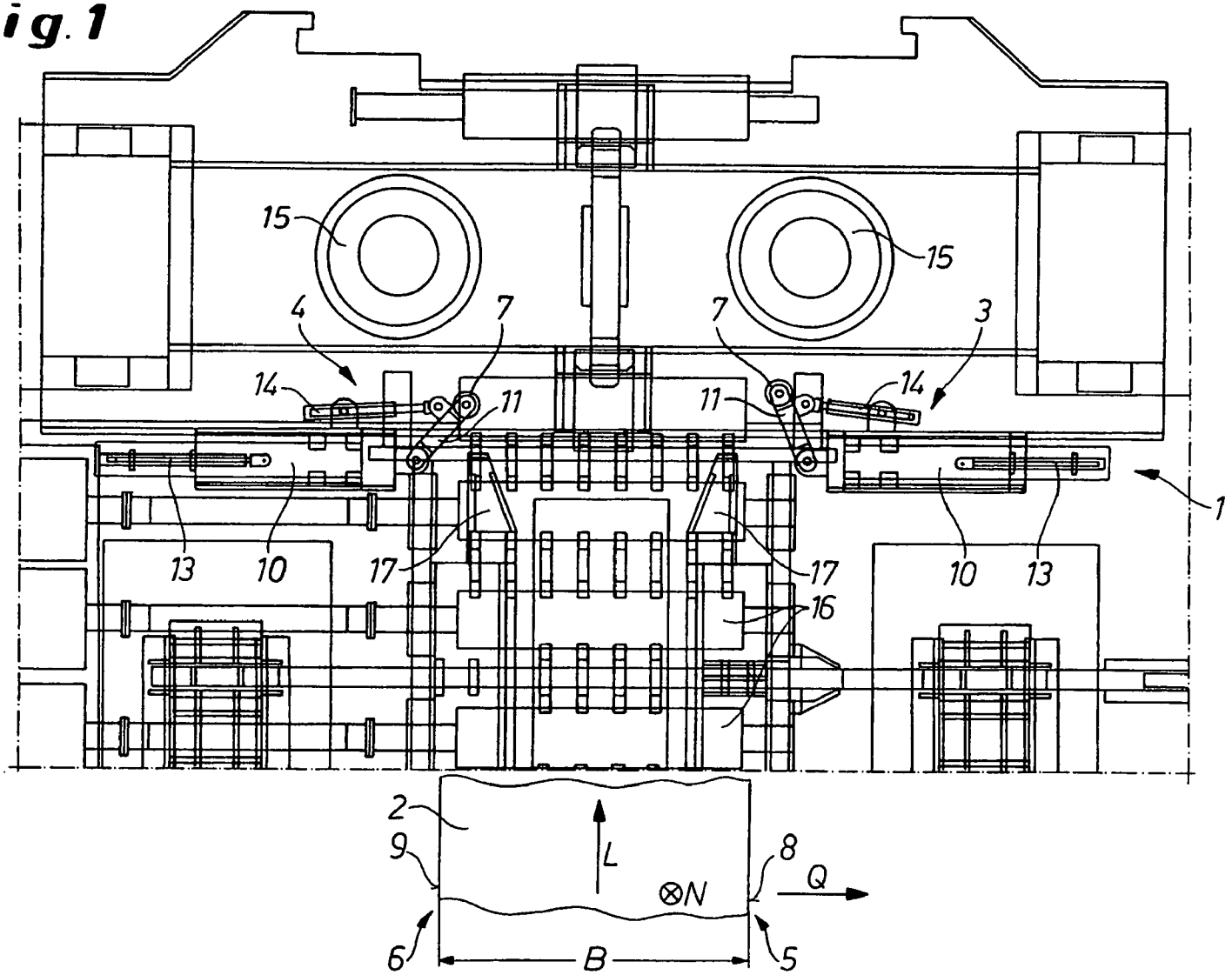
FIG. 1 shows a top view of a rolling mill, in which an edging operation is to be carried out on a metal strip, where a device for measuring the width of the metal strip in accordance with one embodiment of the invention is used.

DETAILED DESCRIPTION OF THE INVENTION:

FIG. 1 shows a rolling mill with two edging rolls 15, with which a metal strip 2 or slab is rolled in direction Q transversely to the longitudinal direction L of the metal strip 2 or slab. The rolling mill has a roller table 16, which conveys the metal strip 2 in its longitudinal direction L in a way that is already well known. In addition, a lateral guide 17 that centers the metal strip 2 in the mill is arranged in a well-known way on both sides of the metal strip 2.

To determine the width B of the metal strip 2, a device 1 for measuring the width is provided. The device 1 consists essentially of two measuring systems 3 and 4 arranged on either side 5 and 6, respectively, of the metal strip 2. The measuring systems 3, 4 can determine the exact position of the lateral edge 8 and 9, respectively, of the metal strip 2, i.e., the lateral border of the strip.

To this end, it is basically provided that a sensor 7, which will be described in greater detail below, is mounted on a moving element 10, which can move the sensor 7 in direction Q until it rests against the edge of the strip or determines the position of the edge of the strip.

Figure 2:
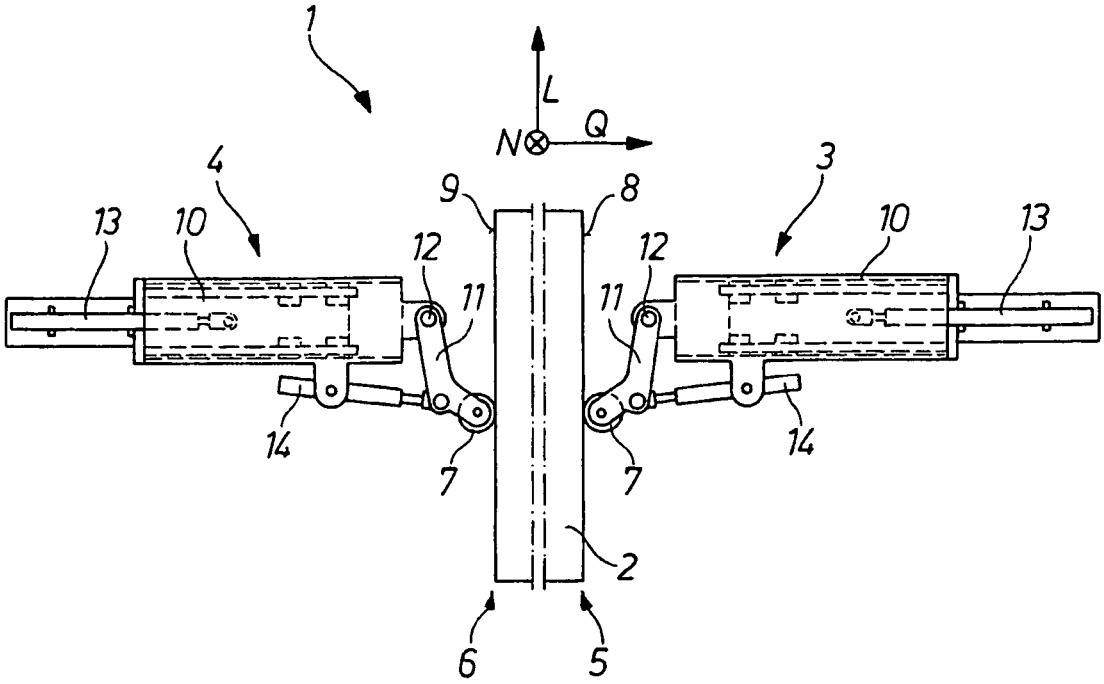
FIG. 2 shows a top view of the mill according to FIG. 1, where only part of the metal strip and the device for measuring the strip width is shown.
Figure 3:
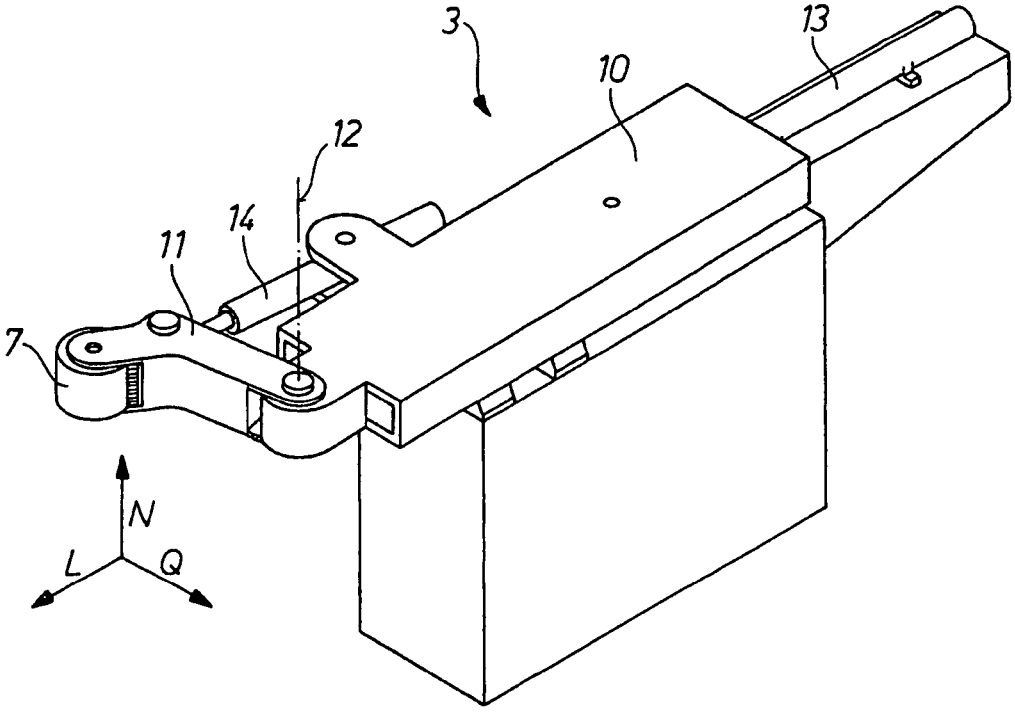
FIG. 3 shows a perspective view of a measuring system of the device for measuring the width of a metal strip.

As is apparent from FIG. 1 in conjunction with FIGS. 2 and 3, a measuring system 10 preferably has a moving element 10 in the form of a linear guide, which can be moved in direction Q by a suitable linear actuator 13. A supporting arm 11 is mounted on the moving element and can swivel relative to the moving element 10 about an axis of rotation 12, which is directed in the direction N normal to the strip 2. The sensor 7 is supported at the end of the supporting arm 11 and in FIGS. 1 to 3 is designed as a dancer roller. The supporting arm 11 is rotated relative to the moving element 10 by another linear actuator 14.

Figure 4A:
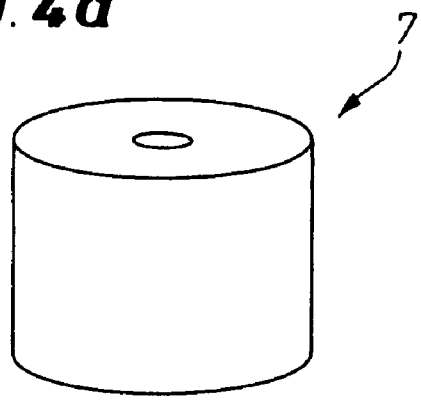
FIGS. 4*a* to 4*f* show various designs of sensors in the form of a measuring roller, which can be used in the measuring system.
Figure 4B:
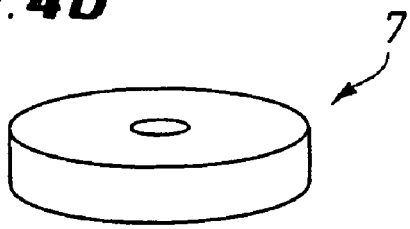
Figure 4C:
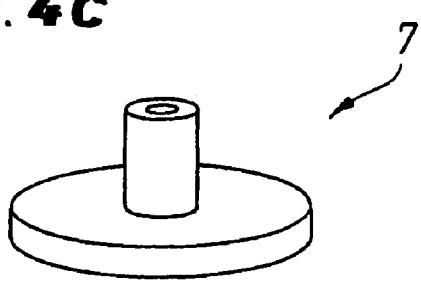

FIGS. 4*a* to 4*f* show various embodiments of the sensor 7 in the form of a dancer roll. As shown in FIG. 4*a*, a conventional roller can be used as the sensor. FIGS. 4*b* and 4*c* show rollers with a disk-like design.

Figure 4D:
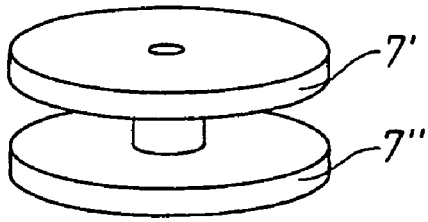
Figure 4E:
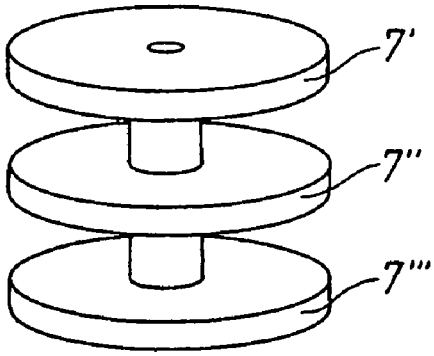

It is also possible to use several disks 7', 7", and 7'" with a common axis (see FIGS. 4*d* and 4*e*).

Figure 4F:
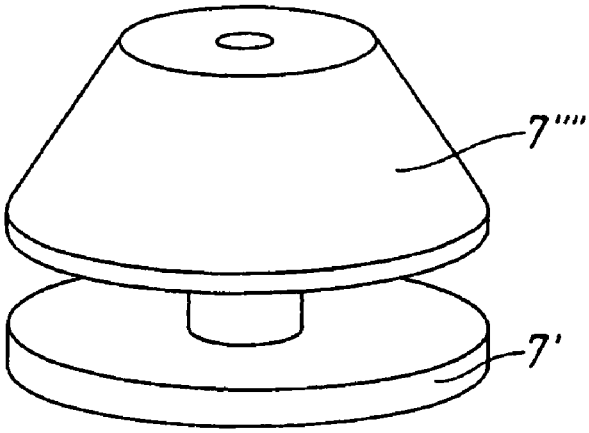

It is also possible to provide a conically shaped disk 7"" at the end, as shown in FIG. 4*f*.

The dancer roller can be designed as a solid roller or as a rotating disk, i.e., the diameter is then significantly greater than the width. The dancer roller 7 can also consist of several disks arranged one above the other and separated by fixed distances. The shape and arrangement of the roller can be chosen in such a way that when the expected strip turn-up occurs at the leading and/or trailing end of the metal strip (slab), the roller can avoid the turn-up, so that damage to the device is prevented. The dancer roller is preferably furnished with a heat-resistant and wear-resistant protective coating.

Figure 2A:
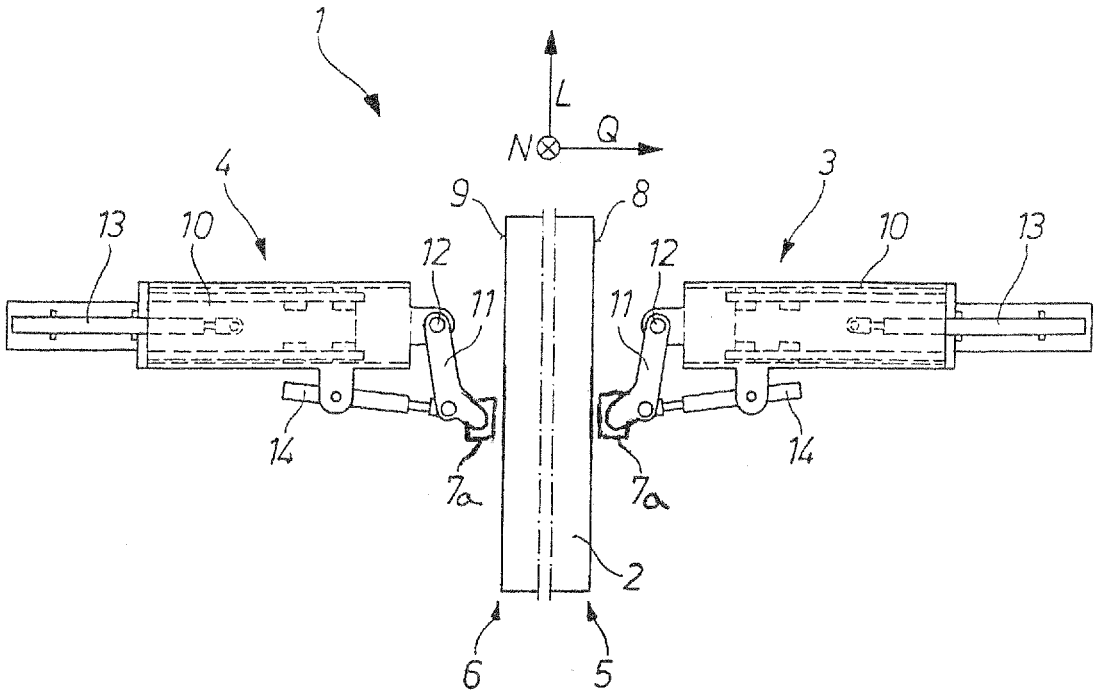
FIG. 2*a* shows a view as in FIG. 2, with a contactless measuring device.

The device 1 for measuring the width scans the metal strip 2 at both edges 8, 9 by means of the dancer roller or rollers 7, 7', 7", 7'". However, it is also possible to use a contactless displacement measuring system schematically shown as an optical sensor 7*a* in FIG. 2*a*.

As illustrated, the dancer roller 7, in order to guide it on the metal strip 2, is supported in a low-inertia and rotatable frame in the form of the supporting arm 11. The axis of rotation 12 of the supporting arm 11 is located on the translationally movable slide in the form of the moving element 10. The two parts, i.e., the moving element 10 and the supporting arm 11, can each be moved with a hydraulic cylinder 13, 14.

The moving element 10, which can also be referred to as a slide, can be moved with the aid of sliding or rolling guides, which can be adjusted to have little or no play. The same is true of the bearing of the supporting arm 11, which can be designed as a frame. The cylinder 13 for driving the slide 10 is arranged in such a way that it moves the slide 10 parallel to the guide and preferably acts in the center plane(s) of the slide 10. To drive the frame 11, the second cylinder 14 is preferably mounted laterally on the slide 10. The cylinder 14 acts on the frame 11 and can move the frame and thus the dancer roller 7 in a well-defined circular arc. Both cylinders 13, 14 can be provided with a displacement measuring system (displacement sensor that measures the cylinder stroke). The displacement measurement can be made in a suitable place (not shown) inside or outside the cylinders 13, 14. In addition, it is possible to determine the position of the frame 11 by means of an angle position transducer.

There is also the possibility of mounting a dancer roller 7 directly on the slide 10, i.e., without a swiveling frame 11 for supporting the dancer roller 7. In this case, the dancer roller 7 is mounted on the slide 10, which guides it directly to the metal strip 2. In any case, the slide 10 is provided with an optimized geometry to offer a large amount of resistance to deformation in the expected loading directions. The given high stiffness is the prerequisite for good measurement accuracy.

Since the width B of the metal strip 2 geometrically represents a distance, and this distance must be defined by two points, the metal strip 2 must be scanned from both sides 8, 9. For this purpose, the device 1 described above is arranged on both sides 5, 6 of the metal strip 2 in such a way that the center axes of the slides 10 are aligned. The two systems 3, 4 form the device 1 for measuring the width B of the metal strip 1.

Since the metal strips 2 vary between a minimum and a maximum width, it is not necessary for the dancer rollers 7 to make contact at an imaginary center plane for the purpose of calibration. It is only necessary for the dancer rollers 7 to be moved sufficiently far towards the minimum strip width that definite contact with the metal strip 2 or the strip edges 8, 9 becomes possible. If a test specimen with well-defined dimensions is used for the calibration, and the rollers 7 can be moved up to the test specimen, then it is possible to make an exact determination of the distance between the dancer rollers 7 by means of the integrated displacement sensor. The theoretical center between the two dancer rollers 7 can be determined by means of this test specimen. If, for measuring the strip width B, the dancer rollers 7, on an imaginary shortest line connecting the points at which the two measuring rollers 7 touch the strip 2, do not form a right angle with a theoretical center plane, then the perpendicularity of the imaginary connecting line can be produced again by coordination of the stored measured values with respect to time adjusted to the strip speed by means of a suitable, expertly selected algorithm.

The force with which the dancer roller 7 is pressed against the metal strip 2 can be automatically controlled. This automatic controllability is advantageous when, for example, the width B of thin strips 2 is to be measured. In this case, a small force can be set in order to protect the edges of the strip from damage and to prevent buckling of the metal strip 2. It is also possible to preset a force limit value, at which the roller 7 moves away from the metal strip 2, to protect the roller 7 from impact and collision with the metal strip 2. A case of this type can arise, for example, in the roughing train of a hot strip mill, if the strip shape starts to deviate or the strip does not flow in the desired manner and eventually experiences a sudden jolt upstream of a dancer roller 7.

The combination of the slide 10 and rotating frame 11 has the advantage that the dancer roller 7 is prepositioned by the slide 10 and can then be moved only with the frame 11. Another advantage of the swivel joint design is the low friction. Low friction is conducive to high dynamics of the dancer roller 7. In addition, the automatic force control operates with less hysteresis in this way and is thus of high quality.

The dancer roller 7 can be guided on the metal strip 2 with a high level of dynamics, which is achieved by virtue of the fact that the roller 7 is moved by an optimized and thus short and low-weight frame 11. This low-inertia design thus has the advantage that at a high strip speed, it can follow the unevenness of the strip edge and thus allow a measurement. At the same time, however, rapid deflection away from the strip is possible in case of strong impacts and disturbances.

The scanner, which is a suitable displacement measuring system in the case of contactless displacement measurement, is mounted on the translationally movable slide 10, which is moved and positioned with a displacement device. An integrated displacement measuring system here too transmits the position of the slide 10. The slide 10 can be guided by sliding or rolling guides, which can be adjusted to have little or no play.

The drive for the slide 10 here too is arranged in such a way that it moves the slide 10 parallel to the guide. A high degree of stiffness of the slide 10 once again is the prerequisite for a high degree of measurement accuracy.

Naturally, in the case of contactless measurement, it is also necessary to scan the strip 2 from both sides 5, 6. To this end, the measuring device described above is arranged on both sides of the strip 2 in such a way that the center axes of the slide and thus the center axes of the scanners are exactly aligned.

The measuring devices are calibrated with a calibration device, with which the measuring device is set to the theoretical center of the strip. This is necessary, because the strip to be measured is guided relative to the theoretical center.

Since the metal strips vary between a minimum and a maximum width, it is necessary to preposition the scanners with the slide 10 to a preset position as a function of the theoretical strip width in order to place the scanners in a predefined, optimum measuring range relative to the strip edge 8, 9.

The position of the slides is determined from the theoretical strip width, the possible center deviation of the strip, the width tolerance, and the optimum measuring range of the scanners.

The necessary measuring range of the scanners is defined by the possible tolerance of the strip width B plus a possible eccentricity of the strip 2.

The strip width is calculated from the position of the two slides 10 relative to each other plus the measurement results of the two scanners 7.

In contrast to the previously known solutions, the direction of measurement is horizontal instead of vertical.

The measuring systems 3, 4 can be free-standing, i.e., they are arranged on the right and left next to the roller table 16 or a similar conveyance device, and there is no other equipment in the immediate vicinity. The measuring devices could also be arranged between the lateral guide 17 and the roughing stand or upstream of the edger. This solution is shown in FIG. 1.

The measuring systems 3, 4 could also be located upstream or downstream of the lateral guide 17 (with respect to the rolling direction).

Figure 5:
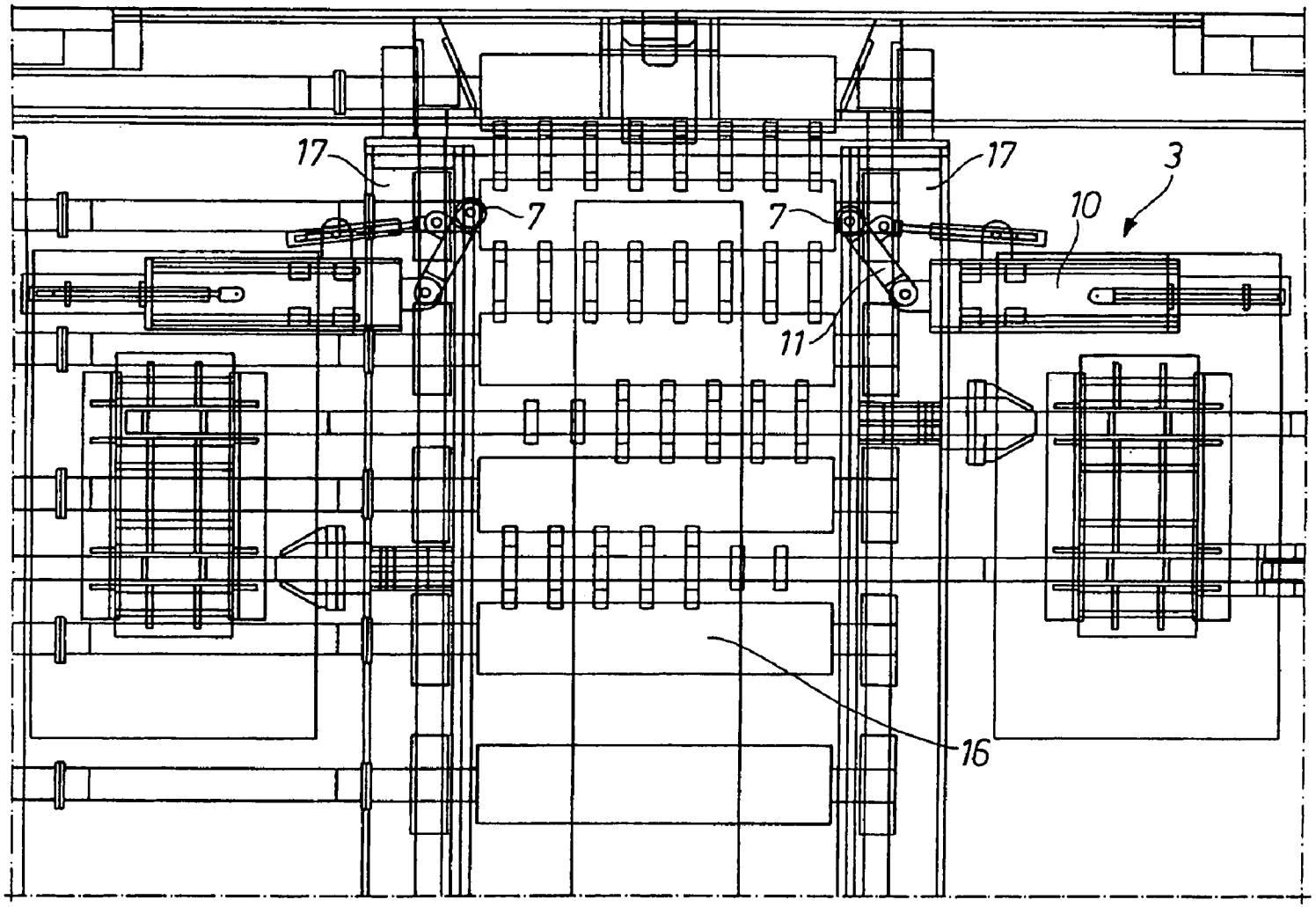
FIG. 5 shows the top view of a rolling mill according to FIG. 1, in which an alternative embodiment is illustrated.
Figure 6:
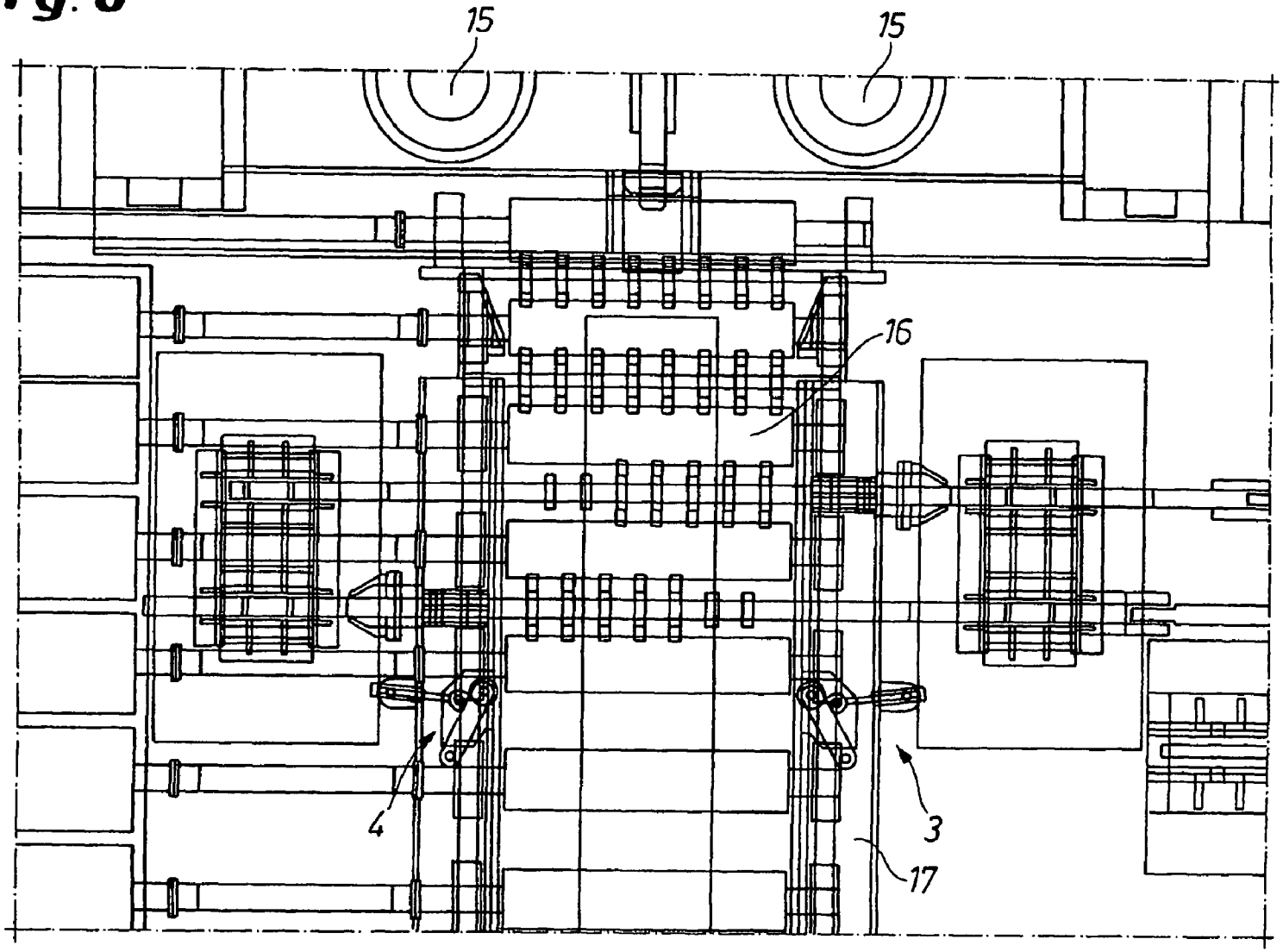
FIG. 6 shows the top view of a rolling mill according to FIG. 1, in which another alternative embodiment is illustrated.

In accordance with alternative embodiments, the measuring systems 3, 4 are installed in at least one other machine or one other machine unit; in this regard, see FIGS. 5 and 6. Thus, e.g., the supporting arm 11 with the dancer roller 7 can be installed in the lateral guide 17 of a roughing stand. A translational displacement device of the slide 10 would no longer be needed then and would be replaced functionally by the lateral guide plate 17.

Since the dancer rollers 7 and the scanner can be aligned with a theoretical center by means of a test device, it is possible to determine the actual center of the slab relative to the theoretical center by evaluating the displacement measurement and/or angular measurement. This applies analogously to the strip edges.

The determined values can then be used as input variables for the open-loop or closed-loop control of other machines and plant parts (automatic control of strip flow, controlled swarming of a metal strip) and thus control the strip flow and/or the strip edge flow of the metal strip.

The measuring devices can be used in all installations in which widths as well as heights and positions of materials must be determined. Specifically, these are: slab casting installations, hot strip mills (wide strip, medium-wide strip, narrow strip), cold rolling mills, wire mills, section mills, plate mills, dressing and straightening lines, billet mills, and slitting lines.

List of Reference Symbols

1 device for measuring the width
2 metal strip
3 measuring system
4 measuring system
5 side of the metal strip
6 side of the metal strip
7 sensor
7' disk
7" disk
7'" disk
7 "" conically shaped disk
8 lateral edge of the metal strip
9 lateral edge of the metal strip
10 moving element/slide
11 supporting arm/frame
12 axis of rotation
13 linear actuator
14 linear actuator
15 edging roll
16 roller table
17 lateral guide
B width of the metal strip
L longitudinal direction of the metal strip
Q direction transverse to the longitudinal direction
N normal

The invention claimed is:

1. A device (1) for measuring the width (B) and/or position of a metal strip (2) or slab, which has at least two measuring systems (3, 4), one on each side (5, 6) of the metal strip (2) or slab, where each measuring system (3, 4) has a sensor (7) designed to detect the lateral edge (8, 9) of the metal strip (2) or slab, and where the sensor (7) is mounted on a moving element (10) that allows it to make translational movements in a direction (Q) transverse to the longitudinal, horizontal direction (L) of the metal strip (2), wherein the sensor (7) is mounted on a swiveling supporting arm (11) of the moving element (10), where the axis of rotation (12) of the swiveling support arm (11) points vertically in the direction (N) normal to the longitudinal, horizontal direction of the metal strip (2) or slab, and where at least one linear actuator (13, 14) is provided for moving the moving element (10) and possibly the supporting arm (11).

2. A device in accordance with claim 1, wherein the moving element (10) is a linear slide.

3. A device in accordance with claim 1, wherein the moving element (10) is part of a rolling installation, especially a lateral guide plate for the metal strip (2) or slab.

4. A device in accordance with claim 1, wherein the sensor (7) is a dancer roller designed to rest against a lateral edge of the metal strip (2) or slab.

5. A device in accordance with claim 4, wherein the dancer roller (7) is as at least one disk that has a diameter significantly greater than its width.

6. A device in accordance with claim 5, wherein several disks (7', 7", 7'") are arranged in succession in the axial direction.

7. A device in accordance with claim 5, wherein, in addition to the one or more disks (7, 7', 7", 7'"), at least one conically designed disk (7"") is mounted after them in the axial direction.

8. A device in accordance with claim 4, wherein the dancer roller (7) has a coating of a heat-resistant and/or wear-resistant material.

9. A device in accordance with claim 1, wherein the sensor (7) is a contactless measuring device.

10. A device in accordance with claim 9, wherein the contactless measuring device is an optical measuring device, especially a scanner.

11. A device in accordance with claim 1, wherein measuring means are provided, with which the translational displacement movement of the moving element (10) and possibly the swivel angle of the supporting arm (11) can be measured.

12. A device in accordance with claim 1, wherein it is part of a slab casting installation, a hot strip mill, a cold rolling mill, a wire mill, a section mill, a plate mill, a dressing and straightening line, a billet mill, or a slitting line.

* * * * *